United States Patent [19]

Favre-Tissot

[11] Patent Number: 4,583,065

[45] Date of Patent: Apr. 15, 1986

[54] ELECTRIC CONNECTION OF BRAIDS ON A CIRCUIT BREAKER TERMINAL

[75] Inventor: Jean-Paul Favre-Tissot, Brignoud, France

[73] Assignee: Merlin Gerin, Grenoble, France

[21] Appl. No.: 677,858

[22] Filed: Dec. 4, 1984

[30] Foreign Application Priority Data

Dec. 13, 1983 [FR] France ..... 83 20089

[51] Int. Cl.[4] ..... H01H 67/00

[52] U.S. Cl. ..... 335/106; 335/16

[58] Field of Search ..... 335/16, 106, 195; 336/192; 219/117.1

[56] References Cited

U.S. PATENT DOCUMENTS 3,067,319 12/1962 Zamboldi et al. .

3,559,119 1/1971 Koennecke et al. ..... 335/16

3,617,970 11/1971 Osaka et al. ..... 335/16 X 4,224,496 9/1980 Riodan et al. .

4,470,027 9/1984 Link et al. ..... 335/16

FOREIGN PATENT DOCUMENTS 1279798 11/1961 France .

985597 3/1965 United Kingdom .

*Primary Examiner*—George Harris

*Attorney, Agent, or Firm*—Parkhurst & Oliff

[57] ABSTRACT

Several braids (26) to connect a moving contact (10) to a lug (14) for the current lead are attached to the lug by welding under pressure, the ends (32) of the braids (26) being placed in slots (34, 36, 38) made in the face of the lug (14). The welding occurs without any need of hard solder.

6 Claims, 6 Drawing Figures

ELECTRIC CONNECTION OF BRAIDS ON A CIRCUIT BREAKER TERMINAL

BACKGROUND OF THE INVENTION

The invention relates to a fixed electric connection of flexible conductors such as braids, with a large section on the end of a flat section terminal or lug.

Circuit breakers or interrupters for current of high intensity, for example of few thousands amperes, comprise flexible conductors, for example shunts or braids, to connect the moving part, especially the moving contact fingers and the lug for the current leading. The end of these flexible conductors is generally linked together onto the upper surface of the lug for the current leading by welding or tightening by bolts. These fixing modes give full satisfaction for conductors of limited section, but are not easily applied to shunts or braids of high section required for the current flow across the above-mentioned circuit breakers.

The object of the present invention is to allow a fixed connection of flexible conductors, especially of high section braids, on a flat shaped lug.

SUMMARY OF THE INVENTION

According to the invention a plurality of slots are made in the face of the end of the lug. The cross-section of the slots corresponds to the one of the conductor or conductors introduced in each slot without any play, the end of the conductor being heated by resistance and compressed to secure the flexible conductors by welding to the lug.

By making more or less deep slots, it is possible to increase the attachment surface of the flexible conductors and to accommodate housings admitting ends of these flexible conductors, in particular braids. As used herein, the flexible conductors will be called braids, but other types of conductors can be used of course.

The electric and mechanical connection of the braids to the lug is made in a welding press of high capacity likely to distort the teeth defined by the slots to compress and to enclose the ends of the braids in the slots and to carry out a welding without any need of hard solder. The absence of tin or another hard solder precludes the diffusion of tin inside the braid and thus to become rigid. The face of the lug for the current lead can be cut into battlements all along its width to define a course of slots, each one of which receives the end or the ends of one or several juxtaposed or superimposed braids in the slot. The braids housed in the slots makes their positioning easier and permits the linking of all the braids to the lug for the current lead by a single operation which does not require any annealing. This cut in battlements reduces the section of projecting teeth, which allows their distortion under the compression force exerted by the press and a compression of the braids ends inserted between the teeth.

The invention is also relative to an electric circuit breaker having several braids, especially for the link between movable contact fingers and the terminal or lug. In the equipments of high intensity, it is common to use several connection braids, the rigidity of which is below the one of a single braid of high section. All these braids which can be connected to one or several fingers of moving contact, is fastened to the lug for the current leading by putting the ends of these braids in slots accommodated in the end of the lug according to the present invention. As an indication it can be noted that according to the invention the link by slot allows one to attach onto a thin lug of 45 mm wide by 8 mm thick five braids each having a section of 40 square mm. Furthermore the section of braid connected to the lug can be increased by making the slots deeper.

The braids stretch outside the slots in the extension of the lug, or perpendicular to the lug according to preferred embodiment. When a large number of braids are connected on the same lug, it is recommended to place several braids in a same slot instead of multiplying the number of slots by reducing the width of the teeth which would weaken the assembly.

BRIEF DESCRIPTION OF THE DRAWINGS

Other advantages and technical data will more clearly appear from the following description, wherein reference is made to the accompanying drawings, in which.

DESCRIPTION OF THE PREFERRED EMBODIMENT

Figure 1:
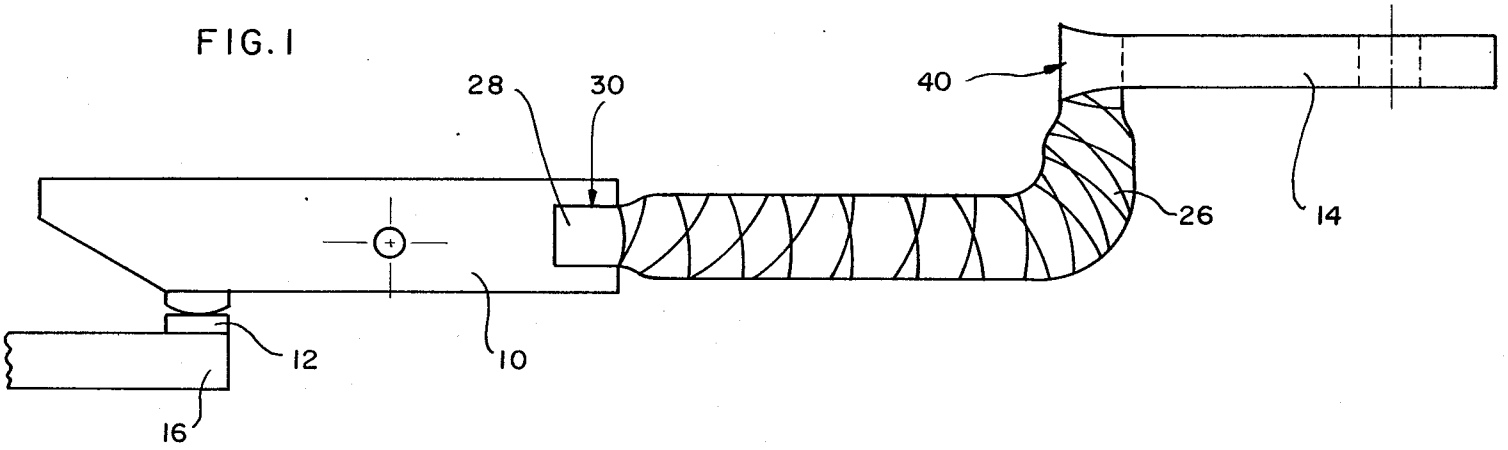
FIG. 1 is an elevational schematic view of an electric contact having link braids connected to a lug for the current leading according to the invention.
Figure 2:
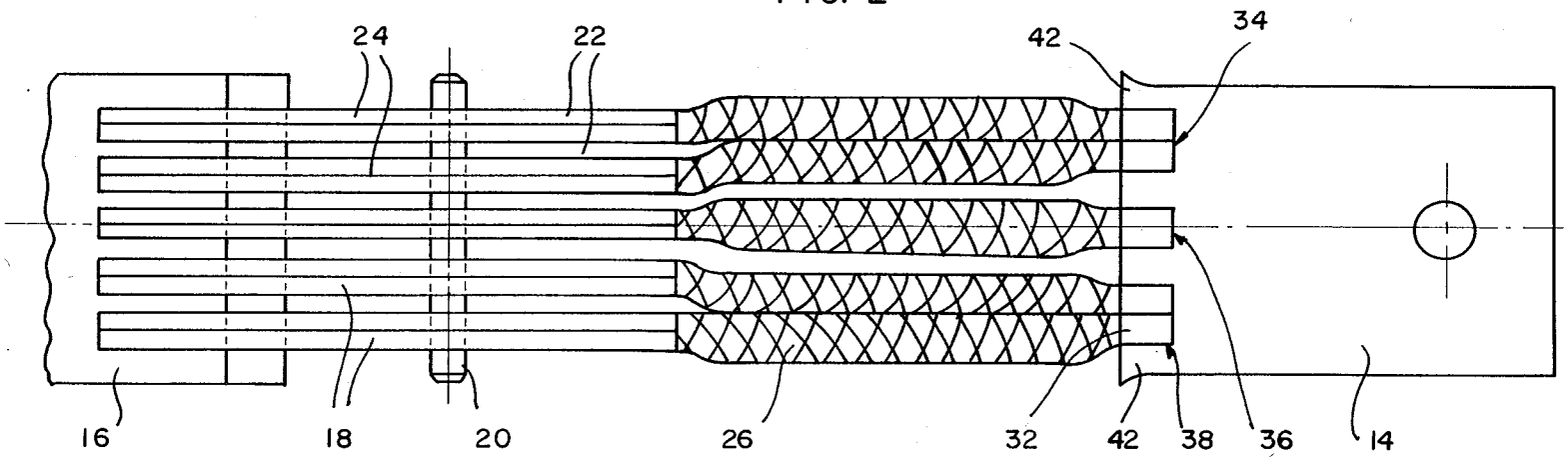
FIG. 2 is a plan view of FIG. 1.

In the figures, a moving contact 10 of an apparatus for switching off high intensity current, for example of an electric circuit breaker of the type described in the U.S. Pat. No. 7,770,922, cooperates with a fixed contact 12. These contacts are connected to a lug 14 for the current lead and to an outgoing lug 16 respectively, the moving contact 10 which is being able to be moved into an opening position to interrupt the current. The moving contact 10 built for rated intensities of several thousands amperes is made by five fingers 18 mounted on the same axis 20 locked with a contact-carrier (not shown) driven by the mechanism of the circuit breaker. Each finger or contact 18 comprises laminations 22, 24, the number of these laminations being able to be different of course. The moving contact 10 is connected to the lug 14 by five braids 26, each one associated with one of the contact fingers 18. The end 28 of the braid 26 is inserted in a slot 30 made at the bottom part of the contact finger 18, the attachment being achieved by a tin soldering. The opposite end 32 is bound to the lug 14 for the current lead by welding under pressure in slots 34, 36, 38. In the example illustrated by the Figures, the lug 14 of a 8×45 mm section shows on its face 40 three notch shaped slots 34, 36, 38 crossing the height of the lug 14. The battlement shaped slots 34, 36, 38 are delimited by teeth 42, each one of the terminal slots 34, 38 receiving of two braids 26, whereas the middle slot 36 receives the end 32 of a single braid. The width of the terminal slots 34, 38 is greater than the slot 36 of course. The braids are introduced in the slots 34, 36, 38, so as to extend perpendicular to the lug 14, although a different arrangement especially in the alignment of the braid 26 with the lug 14 being can be used.

Figure 4:
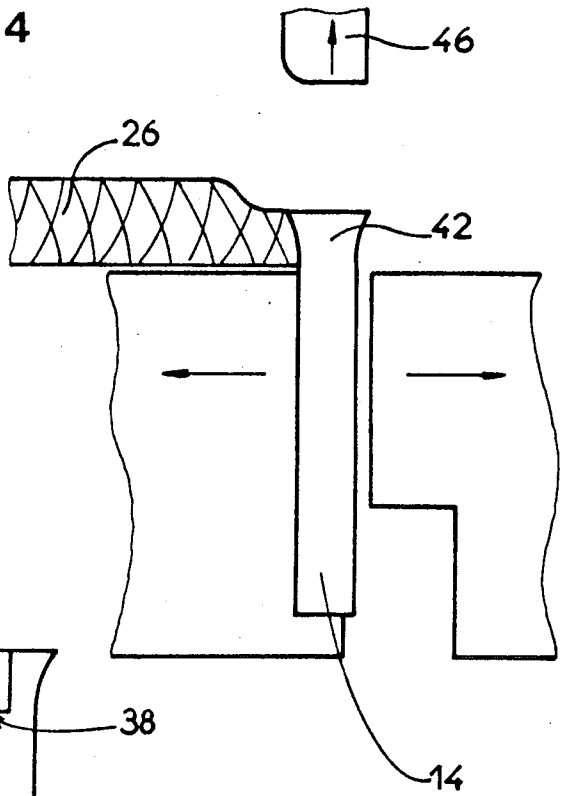
FIG. 4 is a view similar to the one of FIG. 3, showing the assembly after the welding operation.
Figure 5:
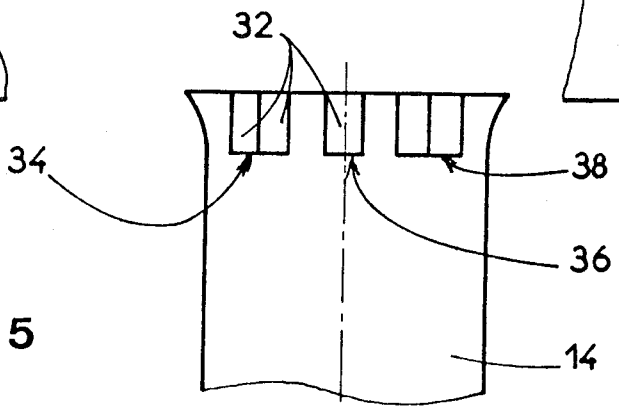
FIG. 5 is a side view of the contact lug after the welding operation.
Figure 3:
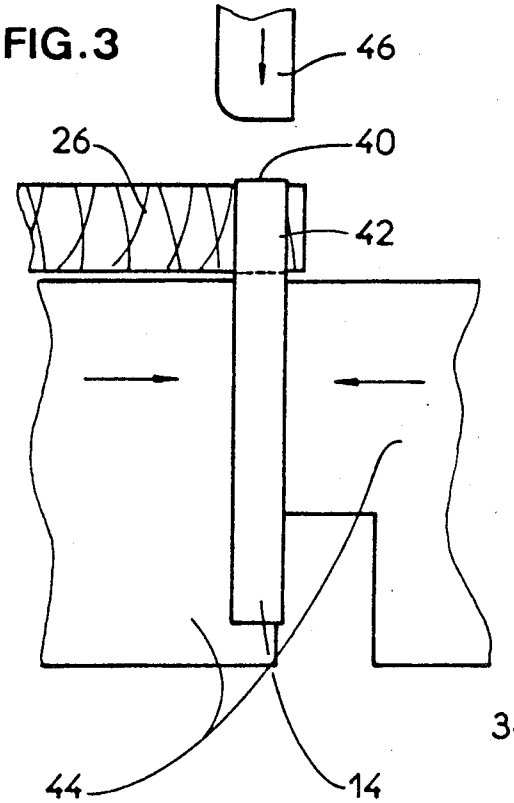
FIG. 3 schematically illustrates the welding press of the lug according to FIG. 1, before the welding operation.
Figure 6:
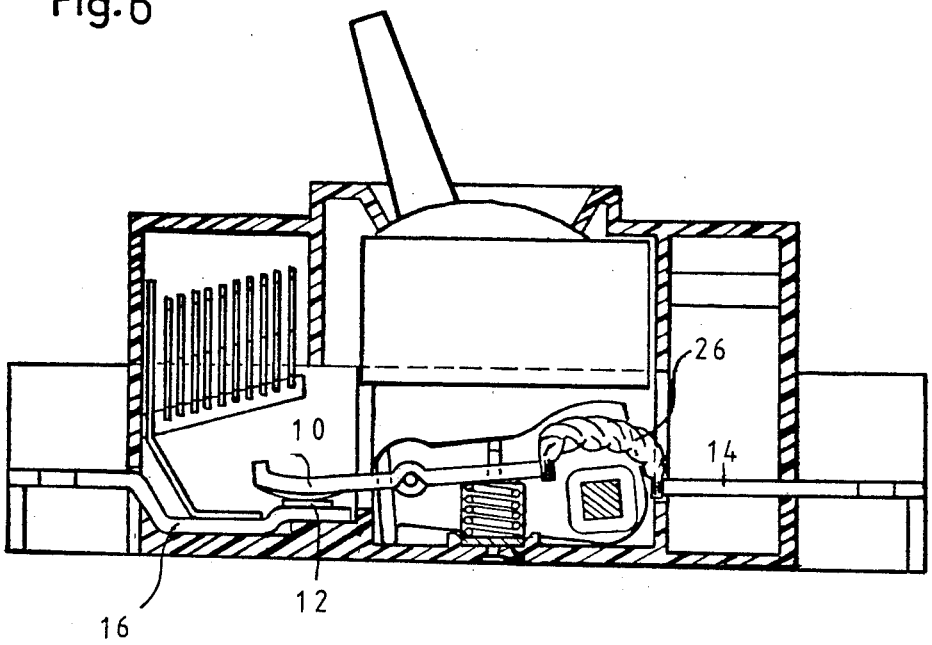
FIG. 6 is a sectional view of a circuit breaker.

FIGS. 3 and 4 illustrates the method used to solder braids 26 to the lug 14. It can be seen that this lug 14 is inserted between the jaws 44 of a welding press, the slotted part facing the moving electrode 46 of the press. The braids 26 are mounted in slots 34, 36, 38, this installation being done by simple insertion of the ends 32 in the slots before the electrode 46 is applied on the face 40 of the lug 14. The electrode 46 covers the whole face 40 and the high pressure (able to reach several thousands kilos) and the effect of electric heating (the current intensity being able to be of several tens of thousands amperes), the teeth 42 are crushed by compressing and welding the braids in the slots 34, 36, 38. The soldering is carried out by heating and compression without any need of hard solder and without any annealing. The crushed or wide-mouthed form of the teeth 42 under the pressure effect is illustrated by FIGS. 4 and 5. The attachment of all the braids 26 is accomplished by a single operation without requiring accessories to hold or position the braids 26. The ends 32 placed in a same slot 34, 38 can be juxtaposed according to the way shown on the Figures, or superimposed, the depth of the slot 34, 38 then being appropriate to the number of superimposed ends 32. It is clear that the ends 32 located in a same slot 34, 38 can belong to braids 26 connected to a same contact finger 18, which allows the reduction of the section of these braids 26, or that any other arrangement is possible. The section of the slots 34, 36, 38 is adapted to the one of the ends 32 so that the latter is put in the slots without any play before the welding operation. According to the invention, the connection by soldering does not increase the over-all dimensions of the connection lug 14 and it keeps the flexibility of the braids 26 which permits their length to be limited. According to the invention the method is especially appropriate to weld copper braids 26 on copper lugs 14, but it can be applied to different welding materials on aluminum lugs. This process is especially interesting to attach several braids 26 to the same lug 14, but it would not go beyond the limits of the invention by applying it to an attachment of a single braid.

It is not necessary to describe in more details the welding press which is a classical type or the method which relates to the mounting of the lug 14 between the jaws 44 of the press, the braids 26 being inserted in the slots 34, 36, 38, and to the application of the moving electrode 46 on the face 40 under high pressure for a soldering in resistance by the usual way. Those skilled in the art can supply these details.

What is claimed is:

1. A circuit interrupter system including cooperating contacts, a plurality of which being relatively movable between open and closed circuit positions, a stationary terminal having a rectangular cross-sectional shape and a rectangular end face spaced from said movable contacts and flexible electrical conductors having one end fixedly attached to said stationary terminal and another end fixedly attached to said movable contacts for interconnecting both electrically, wherein said terminal end face is provided with a plurality of slots, each pair of adjacent slots defining a protruding deformable tooth, the ends of the flexible conductors being inserted inside said slots and welded under pressure to said terminal for causing said teeth to be deformed and to encompass said flexible conductor ends.

2. A circuit interrupter system according to claim 1, having a row of slots extending along the whole length of the rectangular terminal end face, at least one flexible conductor end being inserted inside each slot.

3. A circuit interrupter system according to claim 1, wherein said flexible conductor is constituted by a braid having one of its ends inserted inside one of said slots.

4. A circuit interrupter system according to claim 1, having a plurality of parallel contact arms each having one of said movable contacts mounted thereto at its forward end and movable in a plane movement between open and closed circuit positions, said contact arms being arranged generally in a row perpendicular to said planes of movement, said terminal extending in the longitudinal contact arm direction and having an end face being disposed behind to the rearward end of said contact arms, each contact arm being connected to one flexible conductor, all said flexible conductors being connected to said terminal and having their ends inserted in the slots provided in terminal end face.

5. A circuit interrupter system according to claim 4, wherein said flexible conductor extends perpendicular to the terminal at the output of the slot.

6. A circuit interrupter system according to claim 1, having two flexible conductor ends inserted in the same slot.

* * * * *